United States Patent [19]

Palmans et al.

[11] 4,245,586

[45] Jan. 20, 1981

[54] DEVELOPING DEVICE FOR XEROGRAPHIC COPYING MACHINES

[75] Inventors: Willy J. Palmans, Kessel; William C. Waterschoot, St.Niklaas, both of Belgium

[73] Assignee: AGFA-GEVAERT N.V., Mortsel, Belgium

[21] Appl. No.: 971,410

[22] Filed: Dec. 20, 1978

[30] Foreign Application Priority Data

Dec. 22, 1977 [GB] United Kingdom ..... 53521/77

[51] Int. Cl.[3] ..... G03G 15/08

[52] U.S. Cl. ..... 118/647; 118/651; 118/653; 430/103

[58] Field of Search ..... 427/14, 18; 118/651, 118/653, 658, 647, 655; 430/103

[56] References Cited

U.S. PATENT DOCUMENTS

| | | | |
|---|---|---|---|
| 3,754,963 | 8/1973 | Chang | 427/14 |
| 3,990,394 | 11/1976 | Katakura | 118/651 |
| 4,089,297 | 5/1978 | Morita et al. | 427/18 |
| 4,119,060 | 10/1978 | Mochizuki et al. | 118/653 |
| 4,121,931 | 10/1978 | Nelson | 118/658 |
| 4,187,330 | 2/1980 | Harada et al. | 430/103 |

*Primary Examiner*—Evan K. Lawrence

*Attorney, Agent, or Firm*—William J. Daniel

[57] ABSTRACT

A xerographic developing device for depositing xerographic toner upon an image carrying medium without the use of toner carrier beads which includes an applicator roller for transferring toner from a tray towards the image carrying medium via a scraper element mounted at the exit opening of the tray. Improved regulation of the quantity of toner transferred in this manner is achieved by applying a DC-voltage potential between the applicator roller and the scraper.

8 Claims, 5 Drawing Figures

DEVELOPING DEVICE FOR XEROGRAPHIC COPYING MACHINES

BACKGROUND OF THE INVENTION

This invention is related to xerography and more particularly to a developing device for rendering latent electrostatic images visible.

Conventional xerographic developing techniques such as cascade development, magnetic brush development, etc. require the use of a composite developing material which is a mixture of so-called carrier material and toner particles. By rubbing in contact with the carrier, the toner particles acquire an electrostatic charge of a given polarity which is opposite to that of the electrostatic latent image so that it becomes attracted by the latter.

The fact that a toner/carrier mixture is used in these conventional techniques and that only one component of this mixture namely the toner, is gradually consumed during development, necessitates that replenishment must be carried out with fresh toner only.

In order to precisely dose the exact amount of toner powder, relatively complicated systems have been devised, which however fail to provide the necessary guarantee that replenishing is carried out optimally. As a consequence, the replenished toner/carrier mixture may be over or underregenerated, so that optimum conditions for reproducible copying runs are very difficult to create.

It has therefore been proposed e.g. in Belgian Pat. No. 848,236 filed Nov. 10, 1976 by Escophot, to use the toner developing powder alone so that a carrier material is no longer required. In this way replenishment is very easy to realize as the replacement of used toner by fresh one independent of the mass of carrier, may be carried out without complications.

Development occurs by bringing the toner powder into contact with the electrostatic latent imge. Prior to developing, a charge of given polarity is conferred to the toner particles by rubbing them against rollers, scrapers or other expedients having to fulfil certain requirements—especially in tribo-electrical characteristics—so that the toner particles can be deposited on oppositely charged surfaces. This manner of toner deposition is in the art known as "touch-down" or "transfer" development.

The nature of the preliminary charging process is such that in order to get a defined tribo-electric relationship between the toner particles, the applicator body and the walls of the tray in which toner powder is contained, the materials of construction for the aforementioned mechanical parts have to possess adequate tribo-electric characteristics versus the toner powder. So, an applicator roller will have an electric resistivity of about $10^4$ Ohms/square, whereas a scraper mounted as a toner flow regulating doctor blade will be made of a material which is a dielectric in nature. Under such conditions, it becomes possible to confer a charge of a given polarity to the toner particles.

Unfortunately, this charge is of rather moderate magnitude. Practical values of it fall between 0.2 to 0.5 micro Coulombs per gram (details about the measurement of this parameter will be given further).

As a consequence of the rather low charge acquired by the toner prior to its deposition onto the latent electrostatic image, this manner of development shows the following inconveniences: high contrast images, high densities and a very steep gradation. This is primarily due to the fact that a large quantity of toner is required in order to neutralize the charge of the latent electrostatic image on the image forming medium.

SUMMARY OF THE INVENTION

It is therefore an object of the invention to provide an apparatus by means of which the inconveniences referred to above may be eliminated.

Another object of the provision of a device by means of which the toner charging may be reproducibly regulated.

According to the invention, there is provided: a device for applying a toner composition onto a moving medium carrying an electrostatic latent image, comprising an open-bottomed tray for containing a mass of toner composition an applicator roller beneath the tray with a part of its periphery forming the bottom of said tray, said roller being capable of rotating at a predetermined rotational speed scraper means forming at least a part of one wall of said tray, which scraper means has one edge positioned at a predetermined distance from the periphery of said applicator roller, thereby conferring an initial tribo-electric charge to said toner composition and controlling the thickness of the layer of the latter formed on the surface of said applicator roller and means to rotate said applicator roller in close proximity to said medium carrying said electrostatic latent image, in which device means is provided for applying an electric DC potential of the same polarity as that of said initial tribo-electric charge between said applicator roller and said scraper means for further increasing the magnitude of the electrical charge conferred to said toner composition.

GENERAL DESCRIPTION

In a preferred embodiment of the device according to the invention, the applicator roller rotates in contact with and in the same direction as does the medium carrying the electrostatic latent image. Moreover, its peripheral speed may attain a multiple of the speed of said medium. As a consequence thereof, toner particles falling down to the medium on areas where no electrostatic latent image is present, may be recovered by the applicator roller at the moment they pass through the contact area between the applicator roller and the latent image carrying medium.

In order to provide for an easy method of applying an electric DC voltage between the scraper means and the roller, the latter may comprise an electrically conductive core, provided with a coating or sleeve of a deformable material of moderate conductivity. A preferred range for such conductivities may lie between $10^4$ and $10^6$ Ohms/square area.

The choice of the material of the scraper means is dependent on whether positive or negative toner compositions are to be applied. In the case a positive toner composition is used in development, the scraper material must have a specific resistance ranging from less than one Ohm/square (metals) to $10^{10}$ Ohms/square. It will be clear that in case of contact with metals, it suffices that a dielectric supporting material is used onto which a thin metal layer is applied. For example, tests have been carried out in which the scraper consisted of a support material made of polyethylene terephthalate onto which a layer of gold had been applied by vacuum deposit.

In case a negative toner has to be applied, the specific resistance of the scraper material was found to be in excess of $10^5$ Ohms/square but lower than $10^{10}$ Ohms/-square.

The voltage applied to the series connection formed by the scraper, the applicator roller and the gap therebetween may range to about 1000 Volts. The gap itself has a maximum width of about 200 microns.

It has been found that the presence of an auxiliary DC-voltage across the gap between the scraper means and the applicator roller resulted into the following advantages:

- a controlled charging of the toner composition, so that development becomes more reproducible
- a more uniform toner layer and toner flow
- a higher charging of the toner, so that a less steep gradation is obtained and halftone images can be realized
- a more diversified choice of materials for the scraper and the applicator roller, due to the fact that the charge of the toner is more easily controlled and
- the use of toner compositions having a less critical grain distribution without affecting the uniformity of toner deposit.

In order to reduce the possibility of dust formation at the area where the non-adhered toner powder re-enters the tray, the wall of the latter under which the non-used toner passes may be provided with a supplementary flexible member which exerts a slight pression upon the roller surface. The contact area between said supplementary pressure member and the applicator roller is located somewhat downstream of the wall at the reentry side of the tray. Preferably said pressure member touches the roller periphery according to a tangent plane.

BRIEF DESCRIPTION OF THE DRAWINGS

The scope and spirit of the invention will be illustrated at the hand of a description of a preferred embodiment and in the light of the accompanying drawing, in which.

DETAILED DESCRIPTION

Figure 1:
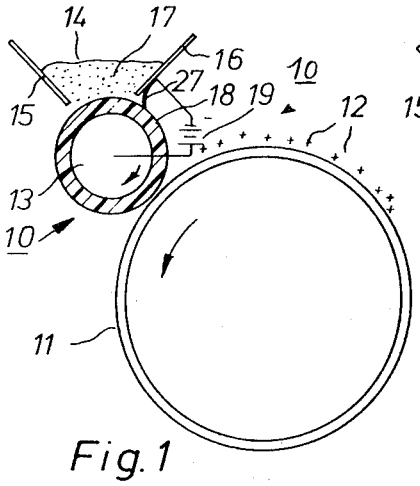
FIG. 1 illustrates a schematic arrangement of a device according to the invention suited for conferring a negative charge to a toner composition.

FIG. 1 shows the arrangement of a device 10 according to the invention when a negative toner composition has to be applied to a medium 11 carrying a positive electrostatic latent image 12. The medium 11 may be in the form of a xerographic drum or belt or other moving surface adapted to receive and hold an electrostatic latent image.

In contradistinction to prior art developing methods (cascade, magnetic brush, etc.) in which use is made of a carrier/toner mixture, the device according to the invention employs a so-called touch-down developing technique. To this end, there is provided, above applicator roller 13, a tray 14 defined by walls 15 and 16, the latter acting as a scraper or toner flow/thickness regulating member for toner composition 17 contained in the tray as illustrated. A separate scraper 27 may be provided on wall 16, if desired. The tray 14 extends in the axial direction of applicator roller 13, the surface of which forms the bottom of tray 14. The tray 14 is provided with end walls (not shown) at its side edges in order to obtain an open-bottomed container. The wall 16 or scraper 27 acts as a doctor blade in that it is positioned with its free edge between 0 and about 200 microns from the surface of applicator roller 13 so that the latter, when rotating in a sense indicated by the arrow is able to regulate the flow or thickness of a layer 18 of toner material. As a consequence of this rotation of applicator roller 13, a layer 18 of toner composition 17 is built up upon the latter and contacted with the latent electrostatic image carrying medium 11. The peripheral speed of applicator roller 13 may exceed the speed of the medium 11 by a factor of, say 5, although the apparatus performs as well when the peripheral speed of roller 13 equals the speed of the latent image carrying medium 11. Preferably, both members rotate in the same direction.

In accordance with the invention there is provided a DC voltage source 19 between the scraper means 16 or 27 and the applicator roller 13. This source provides for a more uniform flow of the toner composition 17 whereas in the meantime the magnitude of the electrostatic charge of the latter may be regulated.

So, a toner composition 17 which in the absence of an electric field in the gap between the scraper means 16 and the applicator roller 13 has a charge of about $-0.5$ $\mu C/g$ gets its charge increased to $-2.3$ $\mu C/g$ when the magnitude of the applied DC voltage attains $-500$ Volts. This charge attains $-6.0$ $\mu C/g$ when the DC voltage is $-1000$ V so that the amount of toner composition necessary to neutralize the charge of an electrostatic latent image is drastically reduced.

The configuration as illustrated in FIG. 1 is intended to be used when a negative charge is to be conferred to the toner composition 17 in order to develop a positive electrostatic image 12.

Figure 2:
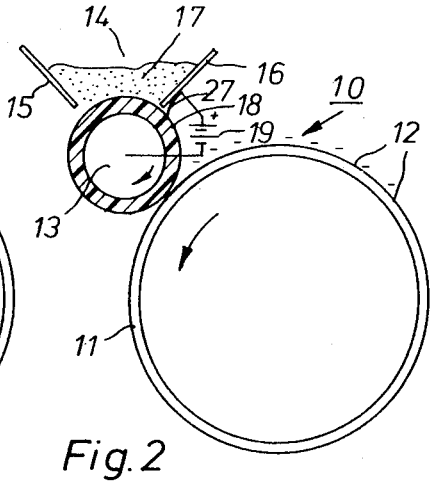
FIG. 2 shows the same arrangement as in FIG. 1 but suited for conferring a positive charge to the toner.

FIG. 2 shows the opposite situation. All the components of the arrangement being the same, they are identified by the same reference numerals.

The DC-voltage 19 has been reversed, so that the toner composition 17 is now brought at a positive DC-potential so that a negative latent image 12 can be developed. In this case too, the charge of the toner may be drastically changed in that a toner composition which has a specific charge of $+0.42$ $\mu C/g$ at zero voltage acquires a charge of $+2.6$ $\mu C/g$ when a $+500$ V DC-voltage is applied to the scraper means 16 or 27. The scraper means may consist of a wall of polyethylene terephthalate onto which a gold electrode is provided by vacuum deposit. Depending on the choice of materials the charge of the toner composition ranges between $+0.3$ and $+0.5$ $\mu C/g$ at zero voltage and between $+2$ and $+3$ $\mu C/g$ for a DC voltage of $+500$ V. It will be clear that the foregoing example serves only to illustrate the influence of the applied voltage on toner charge variations. This relationship is dependent on toner composition and structure. Also the voltage may be increased to values over $+500$ V. The aforementioned values serve only to illustrate the principles of the invention and are therefore not limitative.

Figure 3:
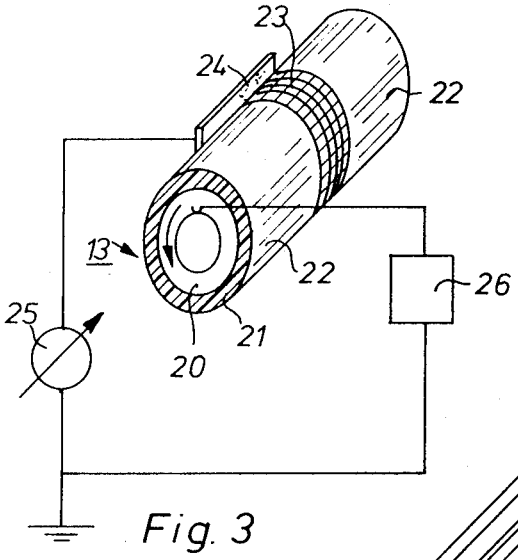
FIG. 3 illustrates the method for determining the specific charge of a toner composition.

FIG. 3 illustrates how the specific charge of a toner composition 17 may be measured as a function of the applied voltage.

To this end, an applicator roller 13, comprising a metal core 20 over which a sleeve or layer 21 of silicone rubber is provided has its surface partly covered with at least one metallic layer 22 so that a narrow area 23 of the roller surface remains unscreened. On the area 23 a thin film of toner composition (not shown) is applied via a hopper (not shown) or other toner dispensing means.

In front of the unscreened surface 23 a metal platen 24 is provided which is connected to an electrometer 25. The metal core 20 of applicator roller 13 is connected to a source of DC-voltage 26, so that an electric field between roller 13 (especially the zone 23) and the platen 24 may be set-up.

Upon rotation of applicator roller 13 and when simultaneously an electric field is built-up between it and the platen 24, toner particles are transported from area 23 towards the platen 24, and the charge accumulated on the latter is simultaneously indicated by electrometer 25.

After a predetermined time, the toner particles on platen 24 are collected and weighed so that the specific charge of the toner can be derived by dividing the charge accumulated by the weight of toner.

In a practical configuration, the diameter of the roller 13 was 25 mm and the length 25 cm; the area 23 was 2 cm in width.

The platen 25 measured 4 by 5 cm and was placed at a distance of 1.2 mm from the periphery of roller 13. The voltage applied was +1000 V of DC. The electrometer was a Keithly 610 C model. After collection of the toner, the latter was weighed with a METTLER H 64 electronic balance with an accuracy of $\pm 10\ \mu g$.

Prior to the application of the electric field, the roller 13 was rotated for 20 s, whereinafter the field was applied for another 3 s during which toner transfer from roller 13 towards platen 24 took place. The roller 13 was rotated so that its peripheral speed attained 33 cm/s (about 250 rev./min).

Figure 4:
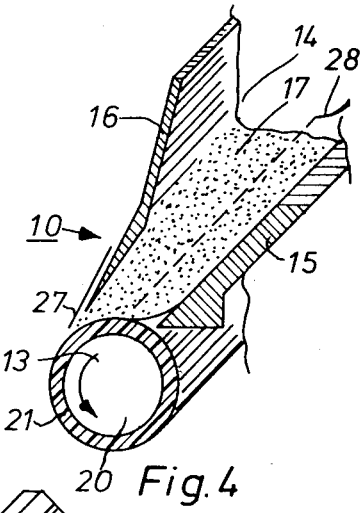
FIG. 4 illustrates a configuration enabling a drastical reduction of the tendency of dust generation in a device according to the invention.

FIG. 4 shows a perspective view of a fragment of another practical embodiment of a device 10 according to the invention. Similarly to the preceding figures, all identical functional or structural parts bear the same reference numerals.

The particular characterizing feature of the device displayed in FIG. 4 is constituted by a member 28 which is resiliently biased against applicator roller 13 at a point on the periphery of the latter situated between walls 15 and 16. In a preferred embodiment, member 28 is attached to wall 15 and tangentially to the uppermost point of the periphery of roller 13. By providing such member 28 it has been proved that the toner composition 17 is better retained in tray 14 and that "leakage" of toner composition 17 through the gap defined by the roller 13 and wall 15 is practically completely avoided.

The material used for member 28 is not critical with regard to its electrical properties.

Figure 5:
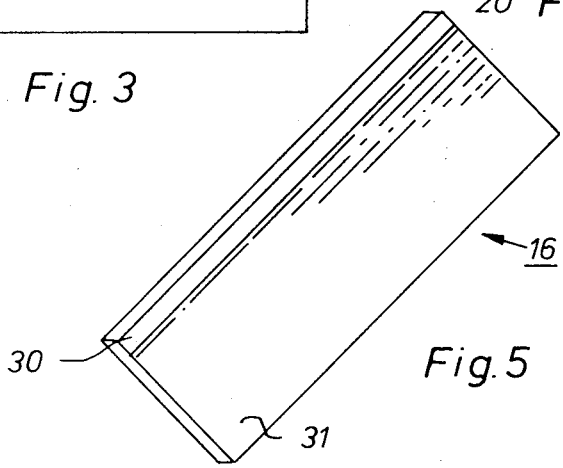
FIG. 5 gives a simplified perspective view of a scraper as used in a device according to the invention.

Finally, in FIG. 5, a practical embodiment of a wall 16 is illustrated. As already described hereinbefore, the choice of the material for manufacturing it is dependent on the dispensing of either positive or negative toner.

In case a positive toner composition has to be applied, the specific resistance of such scraper means may range from values corresponding with those of good conductors, such as metals, to values corresponding with the specific resistance of dielectric materials (say in the order of $10^{10}$ Ohms/square). To this end, use can be made of a solid thick sheet of dielectric material 30, onto which a coating 31 of a metal, a combination of metals or other compositions having a generally low electrical resistance has been deposited. A preferred embodiment of such a scraper means 16 comprises a support of polyethylene terephthalate onto which a layer of gold, silver, etc. has been applied or coated by vacuum deposition.

In case a negative toner has to be dispensed, the specific resistance of the scraper means 16 is more critical. To suit this purpose use must be made of a scraper means 16, the specific resistance of which is lying between $10^5$ and $10^{10}$ Ohms/square.

We claim:

1. A device for applying a toner composition onto a moving medium carrying an electrostatic latent image, comprising:

an open-bottomed tray for containing a mass of toner composition;

an applicator roller disposed beneath said tray with a part of its periphery forming the bottom of said tray, said roller being capable of rotating at a predetermined rotational speed;

scraper means for conferring an initial tribo-electric charge to said toner composition and for controlling the thickness of the layer of toner composition formed on the surface of said applicator roller, said scraper means forming at least a part of one wall of said tray and being positioned with one edge at a predetermined distance from the periphery of said applicator roller;

means to rotate said applicator roller in close proximity to said medium carrying said electrostatic latent image; and means for applying an electrical DC-potential of the same polarity as that of said initial tribo-electric charge between said applicator roller and said scraper means for further increasing the magnitude of the electrical charge conferred to said toner composition.

2. A device according to claim 1, in which said applicator roller comprises a metallic core onto which a coating or sleeve of moderate electrical conductivity is provided.

3. A device according to claim 4, in which said moderate conductivity is between $10^4$ and $10^6$ Ohms/square.

4. A device according to claim 1, in which the predetermined distance between said scraper means and said applicator roller amounts to 200 microns.

5. A device according to claim 1 or 4, in which said scraper means comprises a dielectric blade having metallic coating thereon.

6. A device according to claims 1 or 5, in which said scraper means has a specific resistance ranging from values corresponding with that for metals to $10^{10}$ Ohms/square.

7. A device according to claims 1 or 5, in which said scraper means has a specific resistance ranging between $10^5$ and $10^{10}$ Ohms/square.

8. A device according to claim 1, further comprising a resiliently biased member inside said tray urging against said applicator roller in order to better retain said toner composition in said tray.

* * * * *

UNITED STATES PATENT OFFICE

CERTIFICATE OF CORRECTION

Patent No. 4,245,586 Dated January 20, 1981

Inventor(s) Willy J. Palmans et al

It is certified that error appears in the above-identified patent and that said Letters Patent are hereby corrected as shown below:

In the Claims:

Claim 3, line 1, "4" should read -- 2 --.

Signed and Sealed this

*Twenty-fourth* Day of *March 1981*

[SEAL]

*Attest:*

RENE D. TEGTMEYER

*Attesting Officer* *Acting Commissioner of Patents and Trademarks*